United States Patent [19]

Watanabe

[11] 4,431,127

[45] Feb. 14, 1984

[54] APPARATUS FOR TEMPORARILY BINDING PAPER SHEETS

[76] Inventor: Kenji Watanabe, 6-9, 3-chome, Midorigaoka, Kita-ku, Kokura, Kitakyushu-shi, Fukuoka-ken, Japan

[21] Appl. No.: 305,806

[22] Filed: Sep. 25, 1981

[51] Int. Cl.[3] ..... B25C 5/08

[52] U.S. Cl. ..... 227/76; 227/95

[58] Field of Search ..... 227/93, 95, 68, 73, 227/74, 75, 76

[56] References Cited

U.S. PATENT DOCUMENTS 2,351,042 6/1944 Heller ..... 227/93

2,741,764 4/1956 Kniff ..... 227/93

*Primary Examiner*—Mark Rosenbaum

*Attorney, Agent, or Firm*—Jordan and Hamburg

[57] ABSTRACT

This invention relates to a method of temporary paper sheets binding and an apparatus the same. It is formed by lineage elastic fibroid material having constant length, deforming one of fibroid thready needles to inverse formed 'U', passing through to temporary binded paper sheets from the both end parts of the above-mentioned needle vertically, cutting and separating from abutting fibroid thready needles, and binding temporarily paper sheets. The above-mentioned apparatus is consisting of the 1 member, the 2 member, the 3 member and the 4 member. The 1 member is having an extrusion piece which is projected to the downhand position in the other end part, and a board spring which is set in a lower part of the above-mentioned members. The 2 member forms a slitted part which is projected to the downhand position in the other end part and connects with the above-mentioned extrusion piece, providing a piercing and separating apparatus which is having two parting cross-sectional curved cone parts to the both side parts and an edge part setting to the above-mentioned slitted back part between the above-mentioned cone parts. And also a feed apparatus of the above-mentioned thready needles which is provided a lower side of the above-mentioned members near to the above-mentioned apparatus. The 3 member is having the slitted part which is connected with the above-mentioned apparatus to the other end part. The 4 member is provided that a receiving pressure part which is setting two guiding notches correspond to the above-mentioned cone parts in the other end part, and a board spring is setting to an upper part of the above-mentioned members.

14 Claims, 29 Drawing Figures

APPARATUS FOR TEMPORARILY BINDING PAPER SHEETS

BACKGROUND OF THE INVENTION

This invention relates to a method for temporarily binding paper sheets and an apparatus therefor using fibroid needles.

Various kinds of temporary binding tools and apparatus have been used for binding paper sheets temporarily, for example, metal clips. However, in such cases, the bound paper sheets come apart easily. There is a method of temporary binding which is commonly called "Hotchkiss" (paper-fastener). This is an apparatus where metallic needles are formed as a reverse "C" and they penetrate paper sheets and bend both sides of the needle to the inside on the reverse side of the sheets. This method of temporary binding provides good binding, but when it is necessary to remove paper sheets, it is necessary to use a needle removing tool which is fixed to one end of the apparatus, and it takes a lot of time to remove the needle. In some businesses, metallic binding needles are used wherein one end part is the edge of a needle and the other end part is the head, commonly called a "setting pin", but these had the disadvantage that such a metallic temporary binding gets rusty when kept a long time.

Accordingly, it is an object of the present invention to provide a method of temporary binding using a new temporary binding material and an apparatus for the same which overcomes the above-mentioned disadvantages.

DESCRIPTION OF THE PREFERRED EMBODIMENTS

A fibroid needle of the present invention has both end parts formed as tips of the needle, and a plurality of needles are connected by a center part to form a connected strip of needles. Also it is not necessary that the needles be sharp like the usual needles. The size of the above-mentioned needle depends on the quality of paper sheets, the thickness of the paper sheets, the number of binding papers and the material from which the above-mentioned needle is formed. For example, one fibroid needle may be 0.5 mm in diameter and about 25 mm in length and have elasticity. The above-mentioned example needle has a rounded cross section, but the cross section may be angled, oval or plane. The shape of the tip of the needle could be sharp or slightly rounded for less resistivity when the needle goes through the paper sheets, and also the tip of the needle could be cut vertically. The materials which are suited for producing fibroid needles are synthetic resin materials such as polyvinyl chloride, polyester, a polyamide or a polyvinylidene chloride and inorganic materials such as glass fibers. A fibroid needle which is produced by the above-mentioned materials is deformed into a "U" in the process of temporary binding, and it must be a needle which which does not break during deforming and must have elasticity for restoration to a linear disposition after being bent during binding.

A temporary binding method using fibroid needles of the present invention is characterized in that fibroid needles are temporarily formed into an inverse "U", pass through superimposed paper sheets which are bound temporarily on both sides and cutting and separating the needle from the adjoining fibroid needles. A temporary binding apparatus for fibroid needles of the present invention has a pin binding part consisting of a first member, a second member, a third member and a fourth member. The first member is provided with a projection projecting downwardly relative to the remaining part and the second member has a slit which receives the above-mentioned projection, the slit having two curved cone parts and providing a piercing part which is fixed to the above-mentioned slitted part. The third member has a receiving part which receives the needles along the full length thereof. The fourth member consists of a receiving pressure part with two guiding notches corresponding to the above-mentioned cone parts and a feed element.

Figure 1:
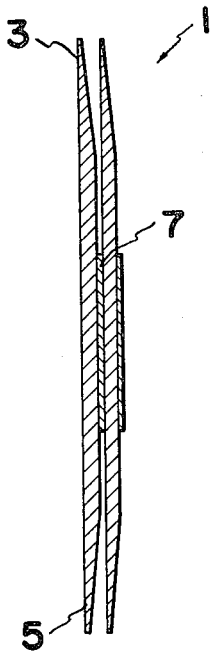
FIG. 1 is a plan view of fibroid needles connected to one another for temporarily binding paper sheets according to the present invention.

In FIG. 1, each fibroid needle has two pointed ends 3,5 and a plurality of parallel needles 1 are connected by a connecting part 7, the connecting part 7 being thinner than the individual needles, and each of the needles is adapted to be separated from the joined strip of needles by the temporary binding apparatus of the present invention. The material of the connecting part 7 may be of the same material as the fibroid needles. A dissimilar material may also be used, such as an adhesive. The tips of the needles are shown as being sharp in FIG. 1, but it is not necessary that they be sharp, as previously mentioned. FIGS. 2 to 7 show a temporary binding apparatus 9 using fibroid needles 1. The above-mentioned apparatus comprises the first member 11, the second member 13, the third member 15 and the fourth member 17, having parts thereof 19, 21, 23 and 25 joined together by a pivot 27. The other end of the first member 11 has a projection 29 at a lower part thereof. The other end of the second member 13 has a piercing element 31 with cone-shaped parts 35, 35 and an edge part 37 as shown in FIG. 2, FIG. 5, FIG. 5*a* and FIG. 5*b*, and also shown in enlarged detail in FIG. 8 with cross-sectional views being shown in FIGS. 8*a* to 8*e*. The second member 13 and element 31 has a slit 33. As shown in FIG. 8*b*, the rear forms the edge part 37. Both cone parts 35, 35 have a concave cross-sectional form which opposes both side parts, making a taper to the tip.

Figure 2:
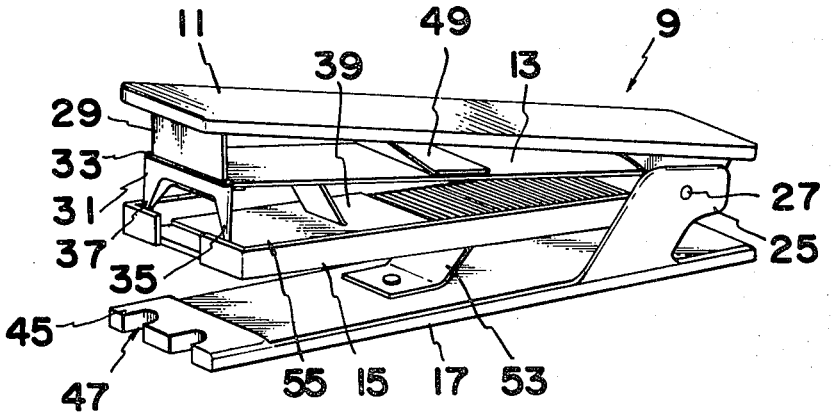
FIG. 2 is a perspective view of a temporary binding apparatus using fibroid needles according to the present invention.
Figure 3:
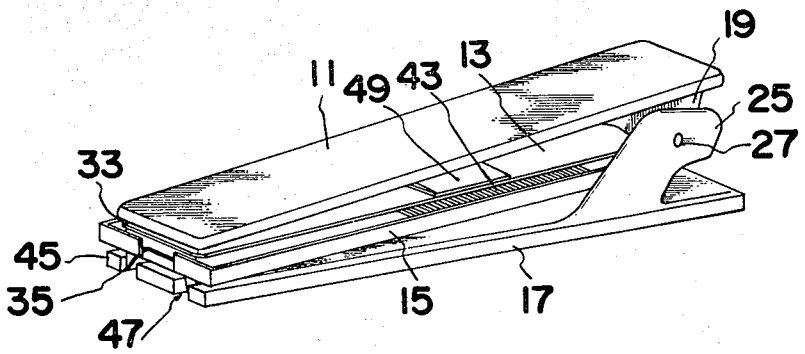
FIG. 3 is a perspective view which shows the closed position of the temporary binding apparatus.
Figure 4:
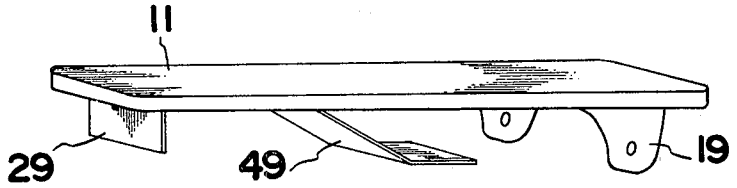
FIG. 4 is a perspective view of the first member of the temporary binding apparatus.
Figure 4A:
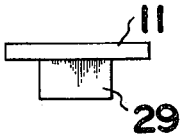
FIG. 4*a* is an end view of the first member.
Figure 5:
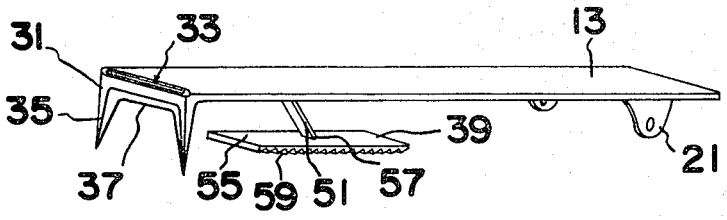
FIG. 5 is a perspective view of the second member.
Figure 5A:
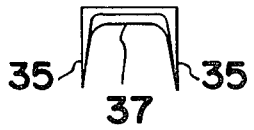
FIG. 5*a* is an end view of the second member.
Figure 5B:
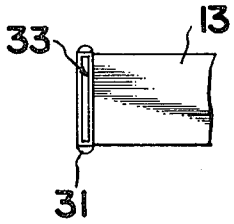
FIG. 5*b* is a partial plan view of a part of the second member.
Figure 6:
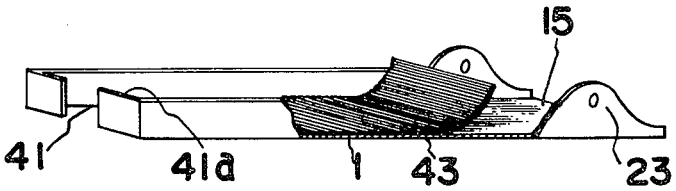
FIG. 6 is a perspective view of the third member.
Figure 6A:
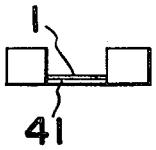
FIG. 6*a* is a front view of the third member.
Figure 6B:
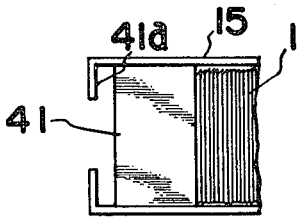
FIG. 6*b* is a partial plan view of a part of the third member.

The needles are completely accommodated in the above-mentioned element 31 in both inside concave sections of the cone part when the needle is temporarily deformed by the pushing pressure of the cone parts 35, 35. The projecting part 29 of the first member 11 passes into the slit 33 of the element 31. As shown in FIG. 2 and FIG. 5, there is provided a feed apparatus 39 for the fibroid needles 1 consisting of a feed element 55 with inverse teeth having concave and convex-formed saw-teeth on a flat spring 51 and a base part 59 which is fixed by a hinge 57 to the tip end of the flat spring 51. As shown in FIG. 6*b*, there is provided a slit 41 on the end of the third member 15, and it is possible to supply the above-mentioned needles continuously from a receiving part 43 which receives fibroid needles 1 which are joined in roll form and which are fed by the feed apparatus 39 of the second member. When the second member 13 and the third member 15 are pivoted toward each other, the feed element 55 pushes the above-mentioned needles as the inverse teeth of the feed element 55 engage the needles. Thus the lead needles are disposed over the slit 41.

Figure 7:
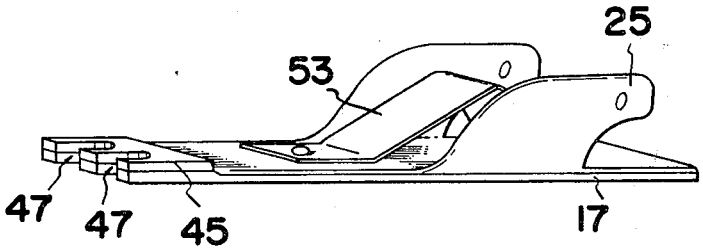
FIG. 7 is a perspective view of the fourth member.
Figure 7A:
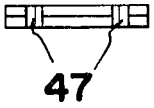
FIG. 7*a* is an end view of the fourth member.
Figure 7B:
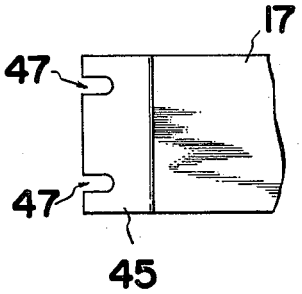
FIG. 7*b* is a partial plan view of the fourth member.
Figure 8:
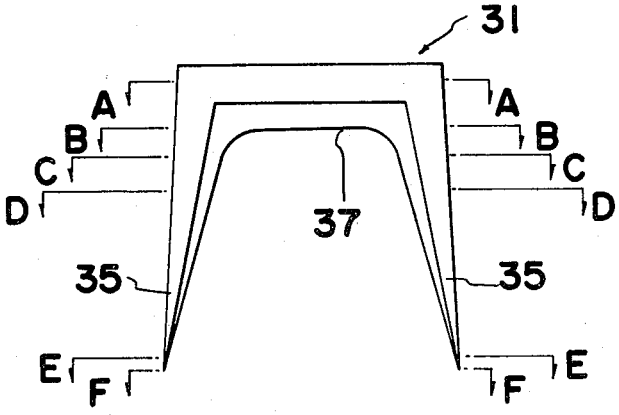
FIG. 8 is an enlarged detail view of FIG. 5*a*.
Figure 8A:
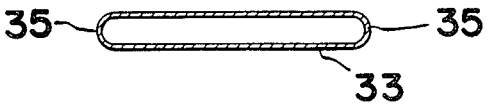
FIGS. 8*a* to 8*f* are cross-sectional views taken along the lines A—A, B—B, C—C, D—D, E—E, and F—F in FIG. 8.
Figure 8B:
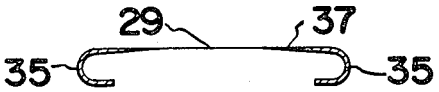
Figure 8C:
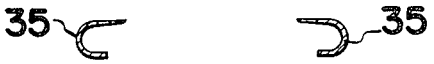
Figure 8D:
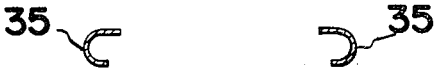
Figure 8E:
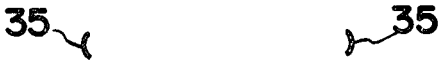
Figure 8F:
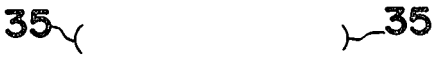

As shown in FIG. 7, FIG. 7*a* and FIG. 7*b*, there is provided a receiving pressure part 45 on the end part of the fourth member 17. The receiving pressure part 45 has two notches 39, 39 which correspond to the cone parts 35, 35 of the piercing element 31. The fourth member 17 is provided with a feed spring 53 extending from the upper face of the fourth part 17.

Figure 9A:
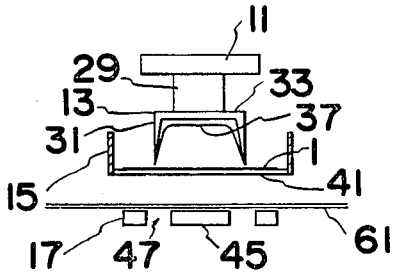
FIGS. 9*a* to 9*h* are views which show the process of utilizing fibroid needles for temporary binding according to the present invention.
Figure 9B:
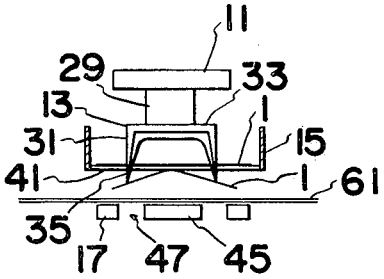
Figure 9C:
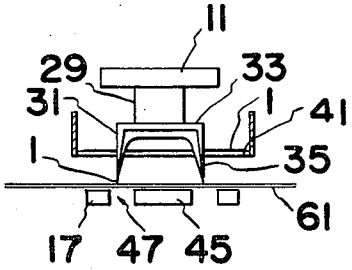
Figure 9D:
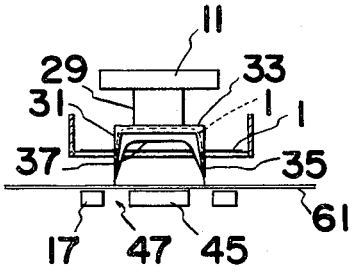
Figure 9E:
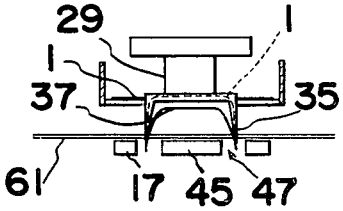
Figure 9F:
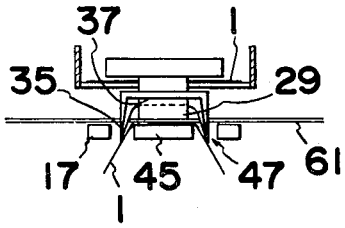
Figure 9G:
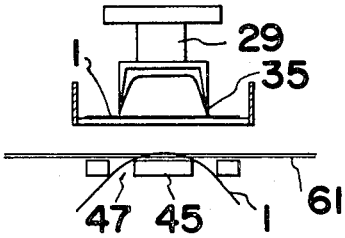
Figure 9H:
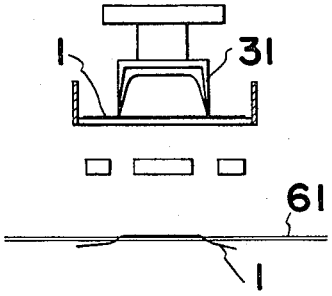

Finally, the process for temporarily binding sheets using fibroid needles of the present invention is illustrated in FIGS. 9*a* to 9*h*. For example, as shown in FIG. 9*a*, paper sheets 61 for temporary binding are placed between the third member 15 and the fourth member 17 and both end parts of the first member 11 and the fourth member 17 are pivoted toward each other by hand. As shown in FIG. 9*b*, the fibroid needle 1 which is disposed in the slit 41 of the third member is engaged by the cone parts 35, 35 of the piercing element 31 and passes through the slit 41 and is pushed down to the position shown in FIG. 9*b*, the bent needle still being connected to the other needles by the connecting part 7. The above-mentioned cone parts then go down further and deform the needles to an inverse "U" in the piercing element 31 and the tip ends of the needle become disposed adjacent the surface of the paper sheets 61 as shown in FIG. 9*c*. The above-mentioned needle is accommodated in the above-mentioned element 31 as shown by broken lines in FIG. 9*d* as the tip ends of the cone parts reach the surface of the paper sheets. The above-mentioned cone parts then pass into the piercing notches 47 after piercing the paper sheets, as shown in FIG. 9*e*. At the same time, the projection 29 which passes through the slit 33 of the second member engages the needle, and pushes the needle to a lower position and cuts and separates the bent needle from the other needles. The needles pass through the paper sheets. The needle which is cut and separated is then pressed on the receiving pressure part 45 by the projection 29 to the position shown in FIG. 9*f*. The device is then released and the third member and the fourth member separate from each other, and the needle remains attached to the paper sheets. Thus the paper sheets 61 are bound together by the needle. When the device is released, the inverse teeth feed element 55 of feed apparatus 39 moves to the left slightly, and another needle is disposed over the slit 41 for the next binding operation.

What we claim are:

1. Apparatus for binding sheets of material using resilient, linear, fibroid needles, comprising a first member having a projection, a second member pivotally mounted on said first member, said second member having piercing means for piercing sheets to be bound, a third member pivotally mounted with said first and second members, said third member having an opening at a longitudinal end portion, said third member having supply means for supplying said needles to a position overlying said opening, and a fourth member pivotally mounted with said first, second and third members, said fourth member having slots for receiving said piercing means, said second member having a slit generally underlying said projection of said first member and juxtaposed to said piercing means such that said projection of said first member is operable to pass through said slit in said second member to pass to said piercing means, said piercing means generally overlying said opening in said third member and generally overlying said slots in said fourth member such that said piercing means is operable to engage a linear needle and push said needle through said opening in said third member and simultaneously temporarily transform said needle from a linear configuration to a generally inverted U-shaped configuration having a pair of temporarily bent leg portions and a central portion, said piercing means being operable to pierce said sheets located between said third and fourth members and to pass said leg portions of said needle through the pierced sheets into said slots in said fourth member, whereby upon withdrawal of said piercing means, said needle returns to its original linear configuration to thereby bind said sheets as said leg portions of said needle are disposed on one side of said sheets and said central portion of said needle is disposed on the opposite side of said sheets.

2. Apparatus according to claim 1, wherein said resilient needles are made of a plastic material.

3. Apparatus according to claim 1, wherein said resilient needles are made from an inorganic material.

4. Apparatus according to claim 1, wherein said resilient needles are made from glass fibers.

5. Apparatus according to claim 1, wherein said resilient needles have a linear configuration and a plurality of said linear needles are joined together at central portions of each needle.

6. Apparatus according to claim 1, wherein said first, second, third and fourth members pivot about a common pivotal axis.

7. Apparatus according to claim 1, wherein said piercing means comprises an inverted generally U-shaped member having two spaced piercing elements joined to a base part, said piercing elements having a generally tapered configuration.

8. Apparatus according to claim 7, wherein each of said piercing elements has at least a partial U-shaped configuration, said projection of said first member passing between said two spaced piercing elements within the U-shaped configuration of each of said elements.

9. Apparatus according to claim 8, wherein said opening in said second member generally underlies said projections on said first member said opening in said third member receiving said projection of said first member.

10. Apparatus according to claim 7, wherein said slit in said second member is disposed in said base part of said inverted U-shaped member.

11. Apparatus according to claim 7, wherein said U-shaped member is constructed and arranged to engage said needle and bend the latter to a generally U-shaped configuration conforming generally to the U-shaped configuration of said U-shaped member.

12. Apparatus according to claim 1 further comprising a first biasing means between said first and second members, and a second biasing means between said third and fourth members.

13. Apparatus according to claim 1, wherein said third member includes a channel for feeding needles of a linear configuration to said opening in said third member.

14. Apparatus according to claim 1, wherein said slots in said fourth member open up on the longitudinal end of said fourth member.

* * * * *